US008432329B2

(12) United States Patent
Johansson et al.

(10) Patent No.: US 8,432,329 B2
(45) Date of Patent: Apr. 30, 2013

(54) ANTENNA CONFIGURATION PROVIDES COVERAGE

(75) Inventors: Martin Nils Johansson, Mölndal (SE); Stefan Johansson, Romelanda (SE); Sven Petersson, Sävedalen (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 318 days.

(21) Appl. No.: 12/997,948

(22) PCT Filed: Jun. 19, 2008

(86) PCT No.: PCT/EP2008/057771

§ 371 (c)(1),
(2), (4) Date: Dec. 14, 2010

(87) PCT Pub. No.: WO2009/152859

PCT Pub. Date: Dec. 23, 2009

(65) Prior Publication Data

US 2011/0095961 A1 Apr. 28, 2011

(51) Int. Cl.
*H01Q 21/00* (2006.01)

(52) U.S. Cl.
USPC ..... 343/893; 343/890

(58) Field of Classification Search ..... 343/890, 343/891, 893
See application file for complete search history.

(56) References Cited

U.S. PATENT DOCUMENTS

| | | | | |
|---|---|---|---|---|
| 5,467,955 | A * | 11/1995 | Beyersmith | 248/219.3 |
| 6,057,806 | A | 5/2000 | Lopez | |
| 6,088,003 | A * | 7/2000 | Bassirat | 343/890 |
| 6,268,828 | B1 * | 7/2001 | Martek | 342/373 |
| 6,323,823 | B1 * | 11/2001 | Wong et al. | 343/844 |
| 6,710,751 | B2 * | 3/2004 | Ianello et al. | 343/890 |
| 7,106,273 | B1 * | 9/2006 | Brunson et al. | 343/890 |
| 7,576,705 | B2 * | 8/2009 | Greenfield et al. | 343/890 |

FOREIGN PATENT DOCUMENTS

| | | |
|---|---|---|
| WO | 2004073107 A | 8/2004 |
| WO | 2005032169 A | 4/2005 |

* cited by examiner

*Primary Examiner* — Tan Ho
(74) *Attorney, Agent, or Firm* — Rothwell, Figg, Ernst & Manbeck, P.C.

(57) ABSTRACT

The invention provides an antenna arrangement for a wireless communication system arranged to have at least one transmit mode and at least one receive mode, the arrangement comprising at least three directional antennas (601, 602, 603) in an antenna configuration. Each directional antenna is arranged to have an azimuthal radiation pattern shaped as a beam, each beam covering an angular sector, such that a combined radiation pattern of all beams in a first transmit mode is arranged to provide a full 360° omnidirectional coverage. By combining localization and polarization (P1, P2) of the directional antennas an omnidirectional radiation pattern substantially without null-depths in the azimuthal plane can be created when the radiation pattern of the directional antennas are combined. The invention also provides a corresponding method and a base station for communication with mobile terminals in a telecommunications network equipped with the antenna arrangement.

23 Claims, 6 Drawing Sheets

ANTENNA CONFIGURATION PROVIDES COVERAGE

CROSS-REFERENCE TO RELATED APPLICATION

This application is a 35 U.S.C. §371 National Phase Entry Application from PCT/EP2008/057771, filed Jun. 19, 2008, the contents of which are incorporated herein by reference.

TECHNICAL FIELD

This invention relates to the technical field of telecommunication networks and specifically to the field of antennas for base stations in a cellular communications system.

BACKGROUND

There are a number of scenarios in mobile communications where the desired cell structure and the desired number of cells are time-dependent. For instance, some parts of a mobile communications system may experience a high load during daytime and a lower load at night. This means that the resource requirement can be drastically different over the course of 24 hours.

Similarly, the long term average load in a mobile communications system will typically increase over time, which means that the overall load in a particular area will change. The system will then have to be reconfigured to incorporate additional resources, for example as realized when increasing the number of cells.

Examples of antenna- and propagation-related solutions to increase load capacity are higher-order sectorization and addition of new sites, both solutions providing an effective cell split.

The solutions above are non-reversible in the sense that once they are deployed, the system complexity and resource allocation is permanently increased. There are no non-trivial ways to reverse cell split using conventional base station configurations.

U.S. Pat. No. 6,091,970 discloses a base station comprising an arrangement of several directional antennas whose individual azimuthal beam patterns achieve a substantially omnidirectional coverage. In one illustrated embodiment the signal transmitted from one base station transceiver is split in three signals which are fed to an antenna configuration of three directional antennas so as to provide an almost omnidirectional or "pseudo-omnidirectional" pattern. All antennas in the antenna configuration use the same polarization for transmit and receive and an additional diversity receiver is using a different polarization. The main drawback with this solution is that a number of sharp null-depths are created in the "pseudo-omnidirectional" pattern which will cause areas of poor or no coverage. The U.S. Pat. No. 6,091,970 includes phase shifters whereby two of the transmitted signals can be shifted in phase. However this solution only moves the interferometer pattern resulting from the combined radiation pattern from the three antennas. This means that the null-depths are moved but not eliminated. There is a need to avoid the problem with interferometer pattern causing null-depths that occurs when antenna patterns with the same polarization are combined.

The effect of the phase shifters in U.S. Pat. No. 6,091,970 only works over a limited bandwidth which means that the solution also has the disadvantage of being narrowband. As the phase shifters are inserted in the output lines the phase shift effect only works for the transmitted signals, i.e. it is a downlink solution only.

U.S. Pat. No. 6,577,879 B1 describes how an antenna pattern control is maintained by employing orthogonal polarization orientation for every other beam. An advantage with the present invention over U.S. Pat. No. 6,577,879 B1 is that it provides a solution also to the problem of providing a combined, omnidirectional radiation pattern without null-depths when employing a solution with an odd number of beams from directional antennas where each beam is covering an angular sector of a full 360° omnidirectional coverage.

There is thus a need for an improved, reliable and low complexity solution that eliminates the drawbacks of the existing solutions.

SUMMARY

The object of the invention is to remove at least some of the above mentioned deficiencies with prior art solutions and to provide.

an antenna arrangement a method for an antenna arrangement a base station equipped with the antenna arrangement to solve the problem of providing an omnidirectional radiation pattern substantially without null-depths when the radiation pattern of any number of partially overlapping beams are combined.

This object is achieved by providing an antenna arrangement for a wireless communication system arranged to have at least one transmit mode and at least one receive mode, the arrangement comprising at least three directional antennas in an antenna configuration. Each directional antenna is arranged to have an azimuthal radiation pattern shaped as a beam, each beam covering an angular sector, such that a combined radiation pattern of all beams in a first transmit mode is arranged to provide a full 360° omnidirectional coverage. Said directional antennas are spatially arranged such that the beams covering neighbouring angular sectors partially overlap and such that the radiation patterns of all beams are arranged to be combined by connecting the directional antennas to the same transmitting line wherein:

- at least two directional antennas covering neighbouring angular sectors and with their phase centres within a circle with a radius below two $\lambda$ are arranged in a first cluster in which all directional antennas have substantially the same polarization, where $\lambda$ is a mean wavelength in the receive/transmit frequency band,
- the antenna arrangement comprises at least one cluster,
- the polarization of the separate directional antenna or the antenna cluster is substantially orthogonal to the polarization of the separate directional antenna or antenna cluster covering a neighbouring angular sector,
- the sum of antenna clusters and, separate directional antennas not included in a cluster, is an even number,
- a directional antenna is part of one cluster only, in the same antenna configuration thus creating an omnidirectional azimuthal radiation pattern substantially without null-depths.

The object is further achieved by providing a method for an antenna arrangement in a wireless communication system having at least one transmit mode and at least one receive mode, the arrangement comprising at least three directional antennas in an antenna configuration. Each directional antenna having an azimuthal radiation pattern shaped as a beam, each beam covering an angular sector, such that a combined radiation pattern of all beams in a first transmit mode provides a full 360° omnidirectional coverage. Said directional antennas being spatially arranged such that the beams covering neighbouring angular sectors partially overlap and such that the radiation patterns of all beams are combined by connecting the directional antennas to the same transmitting line wherein:

at least two directional antennas covering neighbouring angular sectors and with their phase centres within a circle with a radius below two λ are localized in a first cluster in which all directional antennas have substantially the same polarization, where λ is a mean wavelength in the receive/transmit frequency band, the antenna arrangement comprises at least one cluster, the polarization of the separate directional antenna or the antenna cluster is chosen to be substantially orthogonal to the polarization of the separate directional antenna or antenna cluster covering a neighbouring angular sector, the sum of antenna clusters and, separate directional antennas not included in a cluster, is configured to be an even number, a directional antenna is checked to be part of one cluster only, in the same antenna configuration thus creating an omnidirectional azimuthal radiation pattern substantially without null-depths.

The invention also provides a base station for communication with mobile terminals in a telecommunications network equipped with an antenna arrangement according to any one of the antenna arrangement claims.

The invention has the advantage to allow the antenna configuration of a site to be adapted to different scenarios without having to change the antenna installation.

Further advantages are achieved by implementing one or several of the dependent claims.

DETAILED DESCRIPTION

The invention will now be described in detail with reference to the drawings.

The invention is concerned with an antenna arrangement, and corresponding method, for a telecommunications network as e.g. a cellular communication system. The antenna arrangement comprises a number of directional antennas mounted for example to a tower or mast and connected to a base station. The base station is communicating with mobile terminals within the coverage of the antenna arrangement. Each of the directional antennas has a radiation pattern with a main beam covering an angular sector which has a corresponding angular interval, in the azimuthal direction around a vertical axis, being a portion of the total angular coverage interval of the base station, with a certain overlap between neighbouring angular sectors (or overlap between neighbouring beams). An example of a common configuration is three directional antennas with corresponding beams, each beam covering approximately an angular sector of 120°, the configuration providing a full 360° coverage around the base station site. The invention also includes a base station equipped with the inventive antenna solution.

Each directional antenna covers one angular sector. The directional antennas used can be sector antennas, as they are optimized to cover a certain angular sector typically around 120°. Each sector antenna, comprising at least one antenna element, produces one beam for this certain angular sector. The directional antenna can also consist of a number of antenna elements being a part of e.g. an array antenna or other antenna structure, and producing one beam covering one angular sector. Although the invention can be implemented in applications with any number of sectors, the problem addressed mainly exists for applications in which the number of beams from the directional antennas is an odd number equal to or greater than three. Also other types of antennas can be used as long as they are producing one beam for each sector. A common feature for all antenna types used, is that the beams of neighbouring angular sectors are partially overlapping.

Omnidirectional coverage of an antenna arrangement is defined as an antenna arrangement having a radiation pattern covering 360° without null-depths, i.e. there are no angles at which there will be poor or no coverage. The omnidirectional antenna radiation pattern does not have to be isotropic, i.e. the power received or the power transmitted does not have to be equal in all directions.

Figure 1:
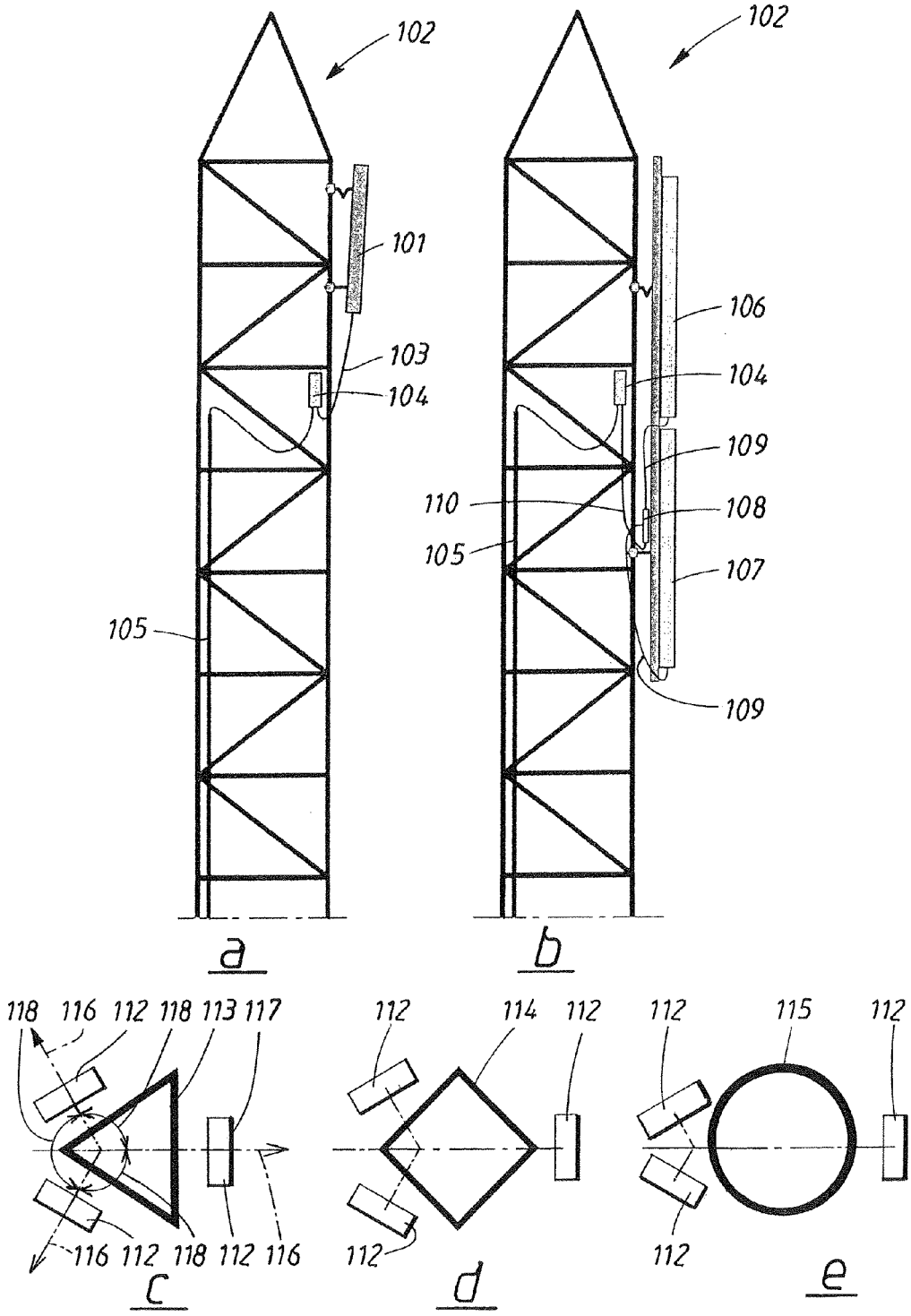
FIGS. 1*a*-1*e* schematically show examples of sector antennas and Tower Mounted Amplifier arrangements mounted on a mast.

FIG. 1 illustrates the principles of mounting the directional antennas, in this example sector antennas, on a tower or a mast. Furthermore, the invention is illustrated for a site with three sector antennas having pointing directions separated by 120°, where either three-sector coverage or omnidirectional coverage is desired. Henceforth a three-sector coverage, or sectorized coverage, means that each directional antenna is connected to a separate transmitting and/or receiving line and omnidirectional coverage normally means that all directional antennas carry replicas of the same signal on downlink, which can be realized for example by having all directional antennas connected to the same transmitting line. The power level of the signals to each directional antenna can however differ e.g. by inserting amplifiers as will be explained below. Downlink means that the directional antennas work in transmit mode and uplink means that the directional antennas work in receive mode. On uplink an omnidirectional coverage can be achieved by connecting all directional antennas to the same receiving line but the signal to each directional antenna can differ depending on from which direction the signal is received. This will be explained more in detail in association with FIG. 2. Other installation scenarios and site arrangements, for example with different number of antennas, sectors and pointing directions, and with omnidirectional coverage on downlink only and three sector coverage, i.e. sectorized coverage, on uplink, are possible within the scope of the invention. Different types of antennas can also be used as described above. Two examples of arrangements are shown in FIGS. 1*a* and 1*b*.

The invention can thus be used in both downlink and uplink operation. In the description the invention is mainly exemplified in downlink operation. Each example is however operational in both uplink and downlink as described above.

FIG. 1*a* shows a single down-tilted sector antenna 101 mounted on an antenna tower 102. The sector antenna is connected through a first transmission line 103 to a Tower Mounted Amplifier TMA, 104, which in turn is connected to transmit/receive circuits of a base station via a second transmission line 105. The sector antenna 101 in this example covers an angular sector width of substantially 120° and the tower is equipped with three identical sector antennas (only one antenna shown in FIG. 1*a* for clarity reasons) with their pointing directions 116 separated with 120°, see FIGS. 1*c-e*.

FIG. 1*b* shows another example with a single modular high gain sector antenna comprising two antenna elements 106 and 107 each connected to a combiner 108 through combiner transmission lines 109. The combiner is connected to the TMA 104 through a third transmission line 110 and then further to the base station circuitry through the second transmission line 105. The antenna elements 106 and 107 in this example covers an angular sector width of substantially 120° and the tower is equipped with three identical pair of antenna elements (only one pair of antennas shown in FIG. 1*b* for clarity reasons) with their pointing directions 116 separated with 120°, see FIGS. 1*c-e*.

The directional antennas mounted on a common tower, mast, roof or roof-top or mounted on walls or similar structures do not necessarily have to be identical but can have different performance in e.g. terms of gain and beam-shape.

FIGS. 1*c*, 1*d* and 1*e* show top views of different arrangements of the sector antennas 112 when mounted on a tower or mast with a triangular 113, square 114 or circular 115, cross section. Pointing direction 116 of each sector antenna is perpendicular to an antenna aperture 117. The pointing directions are separated by a separation angle 118. In the examples in FIGS. 1*c-e* the separation angle is 120° between pointing directions of neighbouring antennas.

For a number of reasons, for example zoning requirements and cost (both Capital and Operational expenditures), it can be advantageous to allow the antenna configuration of a site to be adapted to different scenarios, without having to change the antenna installation. During night when traffic flow normally is low it can be advantageous to temporarily inactivate part of the base station in order to save operational expenditures. When a new base station is installed in can be advantageous to start up with a minimum configuration of the base station, e.g. just one radio chain, to save capital expenditures and then add on more radio chains as traffic is increasing. A radio chain includes the directional antenna and corresponding transmitting and receiving line as well as electronics used specifically for the directional antenna as e.g. a transceiver.

Figure 2A:
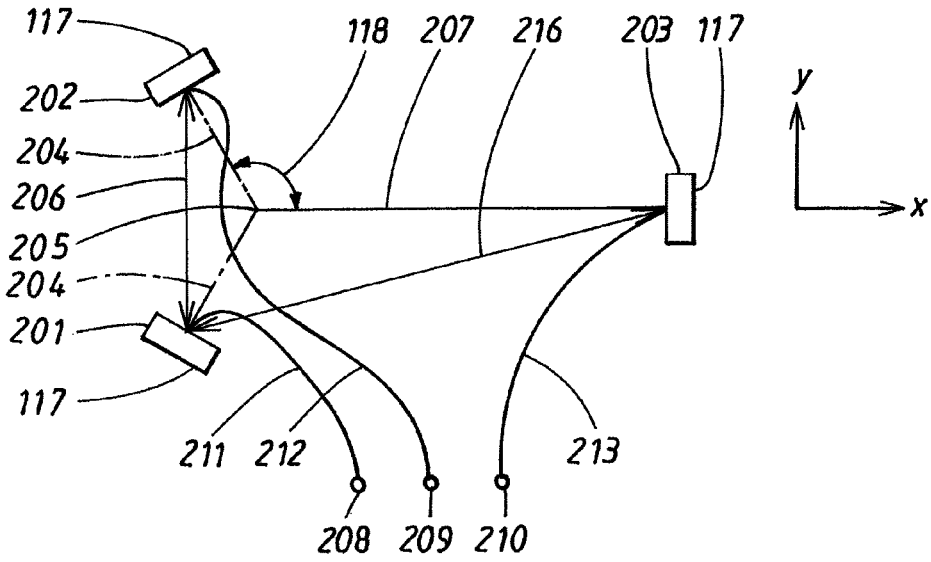
FIGS. 2*a*-2*b* schematically show models of site scenarios.
Figure 2B:
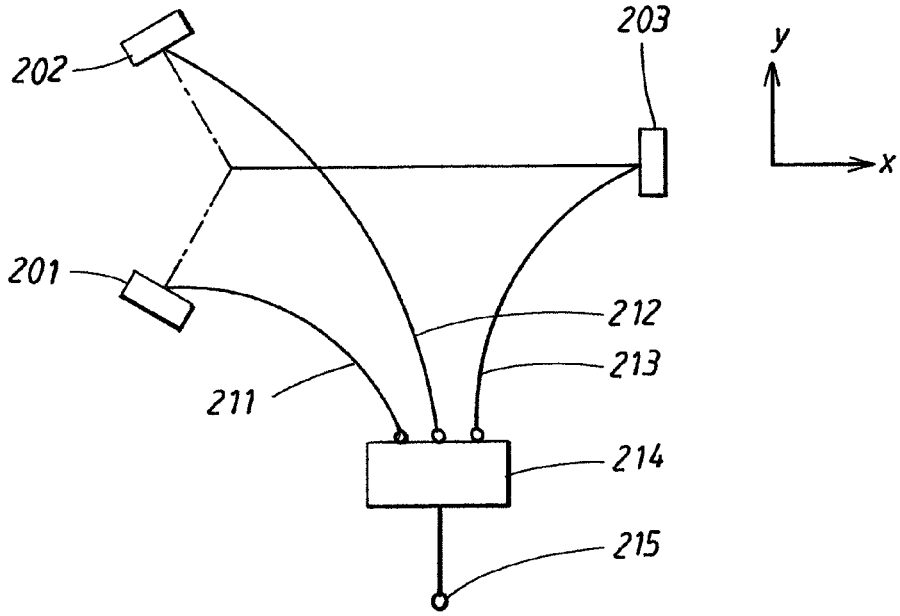

Two different models of site scenarios that use identical antenna arrangements are shown in FIG. 2 for uplink and downlink operation. FIG. 2*a* shows a conventional three-sector scenario providing sectorized coverage with three transmitting/receiving lines, each transmitting/receiving line connected to one directional antenna each. The transmitting/receiving lines can e.g. be part of three separate radio chains (one radio chain per sector), each chain having a separate transceiver. FIG. 2*b* shows an omnidirectional coverage scenario comprising only one transmitting/receiving line being part of a single radio chain. The single transmitting/receiving line is split into three transmitting/receiving lines and each split transmitting/receiving line is connected to one directional antenna each.

FIG. 2*a* is a top view of a first, second and third directional antenna 201, 202 and 203 located in an X/Y-plane, normally a horizontal plane, and configured in a three-sector embodiment. The first 201 and second 202 directional antenna are located a radius r, 204, from an origin 205. The third directional antenna 203 is located a radius R, 207, from the origin 205. All directional antennas have an antenna aperture 117 perpendicular to the corresponding radius vector. The separation angle 118 between neighbouring directional antennas is 120°. The antenna separation D1 between phase centres of the first and the second directional antenna is indicated with arrow 206 and the antenna separation D2 between phase centres of the first and the third directional antenna is indicated with arrow 216. The phase centre of a directional antenna, or any antenna, is defined as "the location of a point associated with an antenna such that, if it is taken as the centre of a sphere whose radius extends into the far-field, the phase of a given field component over the surface of the radiation sphere is essentially constant, at least over that portion of the surface where the radiation is significant". The first directional antenna 201 is connected to a first transmitting/receiving line 208 from e.g. a first radio chain through a first transmission line 211, the second directional antenna 202 is connected to a second transmitting/receiving line 209 from e.g. a second radio chain through a second transmission line 212 and the third directional antenna 203 is connected to a third transmitting/receiving line 210 from e.g. a third radio chain through a third transmission line 213. Each radio chain has its own transceiver and has a certain capacity and available power resource. When the capacity requirement is reduced, e.g. during the night, it can be advantageous to temporarily inactivate part of the base station without changing the antenna configuration in order to save operational costs, for example as incurred due to power consumption in transceiver and refrigeration equipment.

FIG. 2*b* illustrates the situation when all three directional antennas are connected to the same transmitting/receiving line in an omnidirectional coverage configuration. In this embodiment the active electronics, i.e. primarily transceivers, in two radio chains can thus be temporarily inactivated. The operating transceiver is connected to a splitter/combiner 214. A fourth transmitting/receiving line 215, comprising e.g. the transmitting/receiving line 208, 209 or 210 coming from e.g. a radio chain in a base station, is split in the splitter/combiner into three split transmitting/receiving lines each connected to one directional antenna through a the first transmission line 211 to the first directional antenna 201, the second transmission line 212 to the second directional antenna 202 and the third transmission line 213 to the third directional antenna 203. The phase of the signals in one or more of the transmission lines, can be adjusted with phase adjusters, such as true time delay units. The phase adjusters can be used to fine tune the radiation pattern combined from the radiation patterns of the individual directional antennas. The phase adjusters are however optional and not required for the invention. The signals in the split transmitting/receiving lines can also optionally be amplified to compensate for the loss due to the spitting of the signal of the fourth transmitting/receiving line. The amplifiers can be located either in the transmission lines or the transmitting/receiving lines. This compensation can be implemented using for example TMAs on uplink or power amplifiers on downlink, or both, using duplex arrangements, either connected to the fourth transmitting/receiving line 215 or connected to the transmission lines 211-213 or both.

The transmitting/receiving lines 208, 209, 210 and 215 in FIGS. 2*a* and 2*b* can either be a combined transmitting and receiving line or a separate transmitting and/or a separate receiving line, i.e. it will be a transmitting line in transmit mode and a receiving line in receive mode.

FIG. 2*b* thus shows an antenna configuration in a first transmit mode and/or a first receive mode providing omnidirectional coverage. FIG. 2*a* shows an antenna configuration in a second transmit mode and/or a second receive mode providing sectorized coverage.

Figure 3:
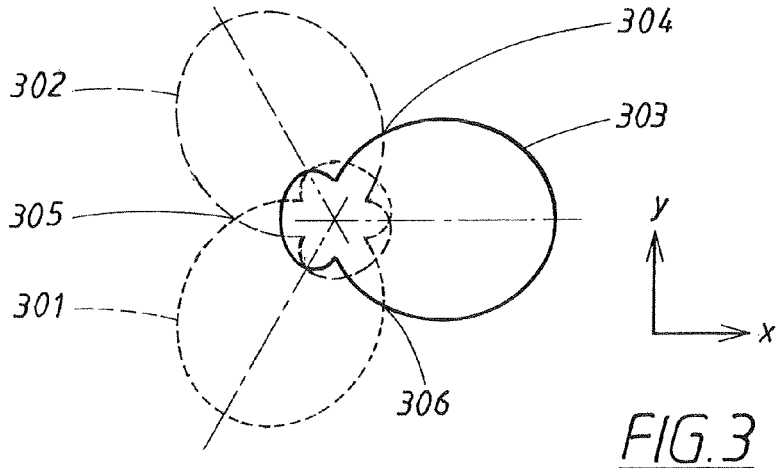
FIG. 3 schematically shows azimuthal antenna radiation patterns for a three-sector site.

Azimuthal, normally horizontal, radiation patterns of a three-sector site, configured as shown in the scenario in FIG. 2*a*, are plotted in FIG. 3. The radiation patterns 301-303 from directional antennas 201-203 provide coverage, i.e., antenna gain, in all directions, with dips in coverage along the sector borders 304-306 as illustrated in FIG. 3. This is called a sectorized coverage with three effective angular sectors or three effective radiation patterns or beams.

By reconfiguring the three-sector site to the scenario in FIG. 2*b*, an omnidirectional azimuthal radiation pattern (providing omnidirectional coverage) is generated. This omnidirectional pattern is the result of a combination of the three separate directional antenna patterns in FIG. 3. With the assumption that the patterns have the same polarization and that all antennas carry the same signal (on transmit), they must be added taking into account both the amplitude and effective phase of the patterns, that is coherently combined, with the effective phase being also a function of antenna location.

Figure 4:
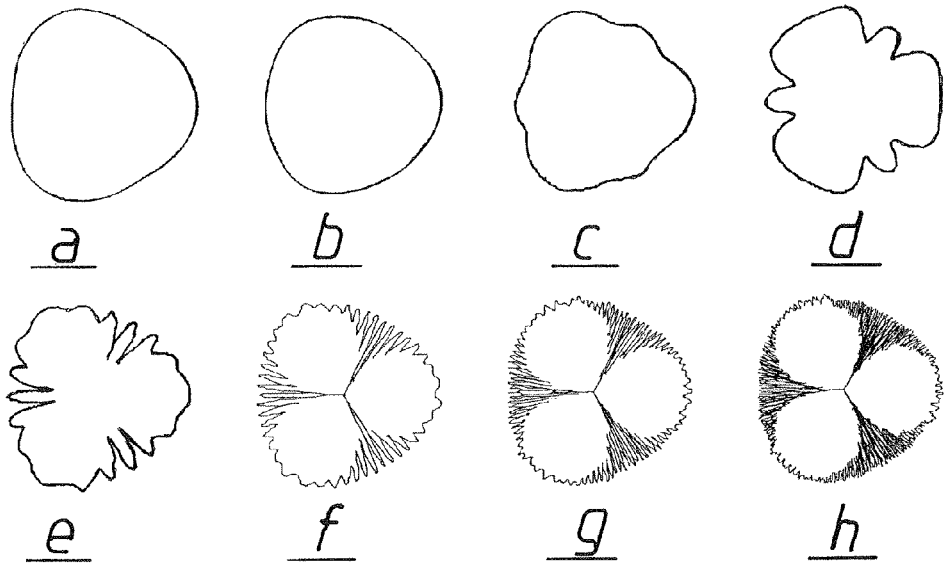
FIGS. 4*a*-4*h* schematically show radiation patterns when combining three antennas at different separation.

The effects of antenna location are clearly illustrated in FIG. 4, which shows the azimuthal radiation pattern, normally the horizontal radiation pattern, resulting from feeding the three directional antennas with the same (coherent) signal according to the configuration in FIG. 2*b* with antenna separations D1=D2 and radius r=R. All radiation patterns 4*a*-4*h* show patterns generated when combining in phase three directional antenna radiation patterns with the same polarization in all directions to generate omnidirectional coverage. For antennas placed (unrealistically) close together, the distances D1 and D2 between phase centres being zero, the effective radiation pattern has a smooth omnidirectional shape which provides coverage similar to that of the envelope pattern of the three directional antennas in FIG. 3 according to the configuration in FIG. 2*a*. This is shown in FIG. 4*a*. As the antennas are moved apart in the azimuthal plane, the resulting radiation pattern starts getting ripples, which develop into angular intervals with severe gain drops, so called null-depths, when the phase centres of the antennas are more than 1-2 wavelengths away from the common origin. In FIG. 4*b* the radii r and R are ¼ of a wavelength, in FIG. 4*c* ½ of a wavelength, in FIG. 4*d* 1 wavelength, in FIG. 4*e* 2 wavelengths, in FIG. 4*f* 5 wavelengths, in FIG. 4*g* 10 wavelengths and in FIG. 4*h* 20 wavelengths. For one example of a typical cellular communication system, the frequency is around 1 GHz which corresponds to a wavelength of 30 cm. For practical reasons, such as the cross-sectional dimensions of the structure on which the antennas are mounted, it is therefore often needed to use distances D1 and D2 above 1-2 wavelengths. This becomes even more necessary for higher frequencies used e.g. in the UMTS (Universal Mobile Telecommunication System) band where the wavelength is around 15 cm.

Angular spread describes the property that signals transmitted from one end of a wireless communications link appear to emanate, on average, from an angular range or interval (the width of which depends on the propagation environment, and distance and direction between the two ends of the communications link, and can be arbitrarily narrow) of directions when observed at the other end of the communications link. From a radiation point-of-view, angular spread can be thought of as a filter that should be convolved with the antenna radiation pattern to get the effective pattern for the given propagation environment. Therefore, radiation pattern gain drop corresponds to loss of coverage when the azimuthal or horizontal angular spread is narrower than the width (at some acceptable relative gain level) of the angular interval experiencing the gain drop, since the averaging effect due to angular spread is insufficient to counteract the gain loss. The larger the separation distance, the narrower the null-depth becomes (the faster the ripple), and the pattern becomes interferometer-like. Thus, for antennas spaced sufficiently far apart as related to the angular spread of the given propagation environment and antenna installation, effective omnidirectional coverage may exist because of the averaging provided from angular spread.

The conclusion is that the relative positions or location of the antennas is a critical design factor if an antenna site is to provide omnidirectional patterns using the sum of sector patterns with the same polarization for directional antennas. But many installations do not provide any (or much) choice with respect to antenna position or location, which means that the combined pattern is very much dependent on how the antennas are placed in relation to each other at the specific installation site. This is true in particular since the effective phase values of the radiation patterns also depend on all the components in the radio chain, for example amplifiers, filters, and feeder transmission lines.

The present invention introduces an antenna arrangement that allows e.g. a three-sector antenna installation to be used for omnidirectional coverage. This is the most common configuration but the invention can also be used for configurations with any other numbers (odd or even) of sectors, the number of sectors being at least three. This will be explained further below. A basic concept of the invention is to combine radiation patterns with different polarizations and to combine radiation patterns with the same (or similar) polarization and coherent signals for antennas that are spaced close together to avoid the problems with radiation pattern ripple, which may result in large angular regions having poor or no coverage.

Figure 5:
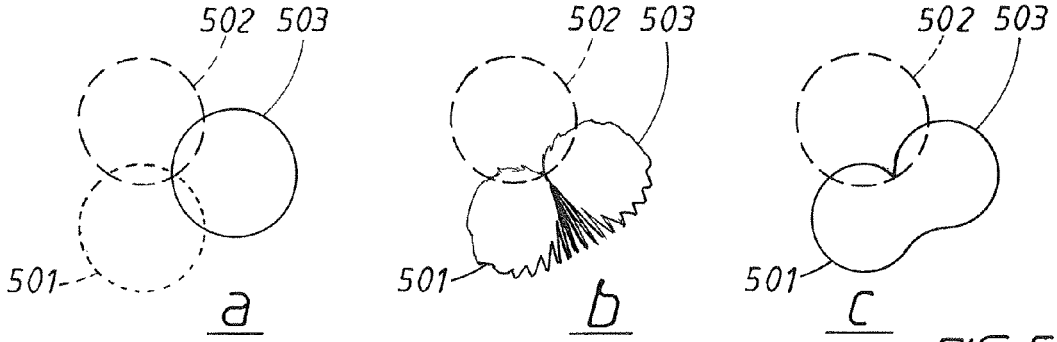
FIGS. 5*a*-5*c* schematically show three examples of radiation patterns for a three-sector configuration.

FIG. 5 shows a three-sector antenna configuration as in FIG. 3 with r=R=5λ, where λ is the mean wavelength in the operating frequency band of the antenna. FIG. 5 further illustrates how a basic concept of the invention based on using different polarizations is applied to the patterns of two out of three directional antennas in a three-sector site configuration where the directional antennas are displaced radially five wavelengths from a common origin. FIG. 5*a* shows three radiation patterns 501-503, or beams, for directional antennas, each directional antenna covering an angular sector, with uniformly spaced pointing directions 116 in the azimuthal plane and fed with independent signals, thus without coherent combining. FIG. 5*b* shows the resulting power pattern 501/503 when two co-polarized directional antennas are fed with replicas of the same signal, with the pattern exhibiting strong ripple due to constructive and destructive interference between the radiation emanating from the two combined directional antennas. FIG. 5*c* shows the power pattern resulting from applying one aspect of the present invention, with the two combined antenna patterns 501/503 being configured to use different, essentially orthogonal polarizations. FIG. 5*c* thus illustrates that by combining orthogonal polarization patterns for partially overlapping beams of neighbouring angular sectors a radiation pattern without null-depths can be achieved.

The concept of using combination of radiation patterns with different polarizations can be applied repeatedly for a given site configuration with any number of antennas greater or equal to two, the effective number of radiation patterns being reduced by one for each combination, until two different effective patterns remain. If these two effective patterns have different essentially orthogonal polarizations, which corresponds to a site configuration with an even number of sectors, in directions where the patterns produce similar coverage, the patterns can be combined to get an effective omnidirectional pattern. Thus for an even sector site configuration, an effective omnidirectional radiation pattern can be achieved by neighbouring angular sectors having always substantially orthogonal polarizations. However, for an odd-number sector site configuration this is not possible, as there will always be two neighbouring angular sectors having the same polarization. The invention now adds location as a further parameter, above orthogonal polarization as described above, to be used in the configuration of an antenna site. By suitable location in a cluster, comprising two or more directional antennas with neighbouring beams, these directional cluster antennas can have substantially the same polarization. There can be one or several clusters. By combining the principles of orthogonal polarization and location, any number of angular sectors can be combined to obtain an omnidirectional coverage as long as the sum of antenna clusters and separate directional antennas not included in a cluster is an even number. This will be explained further in association with description of the figures below.

FIG. 6*a* shows a schematic model (top view) of the antenna arrangement in an X/Y-plane. The beam of a first directional antenna 601 and a second directional antenna 602, with the same polarization 'p1', are combined. The splitter/combiner 214, according to FIG. 2, may have a uniform or non-uniform power splitting. The splitter/combiner 214 shall provide phase coherent combination, taking into account directional antenna 601 (201), transmission line 211, directional antenna 602 (202), transmission line 212, such that the combined pattern does not exhibit null-depths or that the null-depths are minimized. Furthermore the beam of a third directional antenna 603 (203) with a non-identical, substantially orthogonal polarization 'p2', is also combined in the splitter/combiner 214, however without requirements on phase coherency. This means that the pattern for the third directional antenna 603 can be added as power, that is non-coherently, since orthogonal polarizations are independent of each other, meaning that it introduces no ripples to the effective omnidirectional radiation pattern. The first and second directional antenna, with polarization 'p1', are placed a radius r1, 606, and r2, 605, from an imagined coordinate system origin 607 whereas the third directional antenna, with non-identical polarization 'p2', is placed a radius R, 608, from the same origin. The radius r1 is the distance between the origin 607 and the phase centre of the first directional antenna 601 and the radius r2 is the distance between the origin 607 and the phase centre of the second directional antenna 602. The radius R is the distance between the origin 607 and the phase centre of the third directional antenna 603. The radius r1 and r2 are in this case the same but this does not necessarily have to be the case. Antennas within a common cluster should be placed in substantially the same plane, parallel to the X/Y-plane. The distance D1, 609, between phase centres of the first and second directional antenna should be less than about 3-4 wavelengths of the mean frequency in the combined transmit/receive band. This can be seen from FIG. 4. When $r \leqq 1\text{-}2\lambda$ the null-depths are not fully developed. In the configuration of FIG. 4, when $r=\lambda$, D1 becomes $2*\sin 60°*\lambda \approx 1.7\lambda$ and when $r=2\lambda$, D1 becomes $3.5\lambda$.

Figure 6:
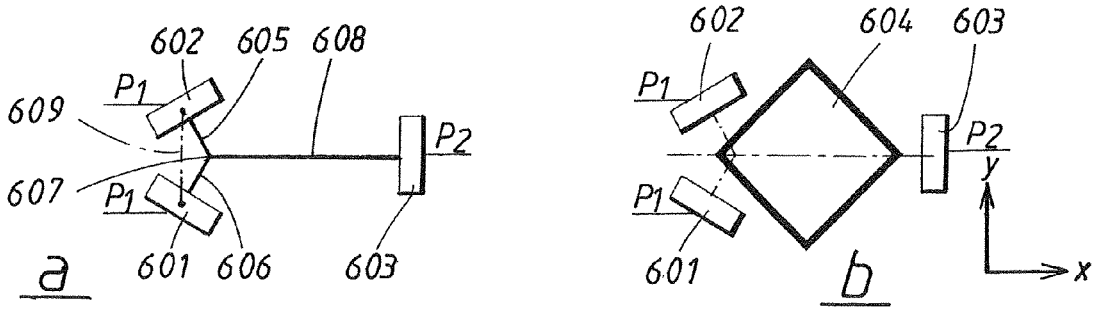
FIGS. 6*a*-6*b* schematically show a model of an antenna arrangement according to the invention in an embodiment for a three-sector site.

The first and second directional antenna, in the configuration of FIG. 6, are said to comprise a cluster. A cluster can include more than two antennas as will be shown below. Antennas, covering neighbouring angular sectors and having substantially the same polarization, that are located such that their phase centres can be inscribed within a circle with a radius of approximately 1-2 wavelengths $\lambda$, where $\lambda$ is the mean wavelength in the receive/transmit frequency band, are defined to belong to the same cluster. This circle is henceforth called the $\lambda$-circle. The radius of the $\lambda$-circle should be below $2\lambda$. When two or more antennas are located close together it is possible that one antenna A can belong to two or more clusters depending on where the centre of the $\lambda$-circle is located. In that case there will be multiple possible antenna configurations depending on which of the clusters antenna A is included into.

FIG. 6*b* shows the first, second and third directional antenna mounted on a tower 604 with a square cross section. This is one installation scenario for which the present invention is well suited, since the antenna separation distances become too large to allow conventional pattern combination, i.e. not taking into account both antenna polarization and antenna location.

Figure 7:
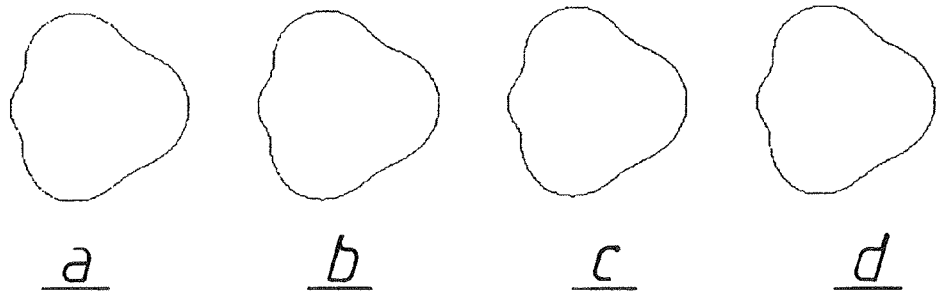
FIGS. 7*a*-7*d* schematically show radiation patterns for an antenna arrangement according to the invention with variations in distance between antennas having different polarization.

One benefit of the present invention is clearly illustrated in FIG. 7 which shows the azimuthal, normally the horizontal, radiation pattern resulting from feeding three directional antennas, such as sector antennas, arranged according to FIG. 6 with the same, that is replicas of the same, (coherent) signal for different values of the radius R and with the third directional antenna having substantially orthogonal polarization to the polarization of the first and the second directional antenna. The combined radiation pattern is, as will be shown, independent of the location (radius R) of the third directional antenna. This means that one can place the third directional antenna at a position, or location, that is several wavelengths from the positions of the first and second directional antenna, for example on the "opposite" side of a tower as shown in FIG. 6*b*. This means that the directional antennas can be located such as not to be obscured by the structure to which they are mounted, in this case a tower. In all radiation patterns in FIG. 7 the radius r is equal to a half wavelength. In FIG. 7*a* the radius R=2 wavelengths, in FIG. 7*b* R=5 wavelengths, in FIG. 7*c* R=10 wavelengths and in FIG. 7*d* R=20 wavelengths. As can be clearly seen any value of R will generate substantially the same radiation pattern. The third directional antenna 603 in FIG. 6 can thus be placed at any distance from the first and second directional antenna. For practical reasons it is often more beneficial to use the possibility to locate the third directional antenna far from the antennas in the cluster. However the third directional antenna, having a substantial orthogonal polarisation to the polarization of the first and second directional antenna, can be located at any distance from the first and second directional antenna, i.e. it can also be located within the $\lambda$-circle.

Figure 8:
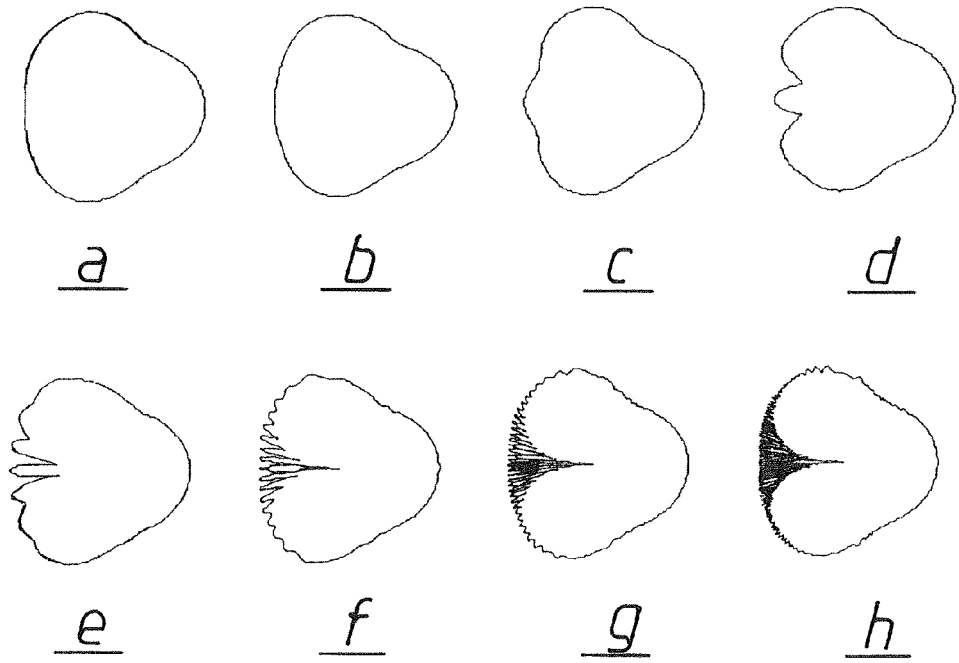
FIGS. 8*a*-8*h* schematically show radiation patterns for an antenna arrangement according to the invention with variation in distance between antennas having the same polarization.

The requirements on the installation of the first and the second directional antenna (the antennas being close together) are illustrated in FIG. 8 which shows the azimuthal radiation pattern, normally the horizontal pattern, resulting from feeding the three directional antennas arranged according to FIG. 6 with the same (coherent) signal, for different values of the radius r with R=10 wavelengths and with the third directional antenna having substantially orthogonal polarization to the polarization of the first and the second directional antenna. In FIG. 8*a* the radius r for the first and the second directional antenna is 0 wavelengths which is only theoretically possible, in FIG. 8*b* r=¼ wavelength, in FIG. 8*c* r=½ wavelength, in FIG. 8*d* r=1 wavelength, in FIG. 8*e* r=2 wavelengths, in FIG. 8*f* r=5 wavelengths, in FIG. 8*g* r=10 wavelengths and in FIG. 8*h* r=20 wavelengths. As expected, the behaviour in the angular region between the pointing directions of the first and the second directional antenna is similar to the behaviour for the case when radiation patterns with the same polarization for all directional antennas are combined in a configuration with r=R as illustrated in FIG. 4.

As can be seen in FIG. 8, null-depths are still not fully developed when $r \leqq 1\text{-}2\lambda$. In the configuration of FIG. 6 this corresponds to D1, the distance between phase centres of the first and second directional antenna, being between $2*\sin 60°*\lambda \approx 1.7\lambda$ and $4*\sin 60°*\lambda \approx 3.5\lambda$. Thus, an implementation using the present invention should suitably be applied in such a way that the antennas that can be placed with their phase centres within the λ-circle (as defined above) are identified and set to have the same polarization when respective radiation patterns are combined.

This invention thus allows multiple antennas to be connected to the same transmitting/receiving line while generating radiation patterns without null-depths, i.e., radiation patterns with limited gain drop due to amplitude ripple, by using a combination of antenna installation rules and polarization requirements. In summary, this means that an antenna arrangement for a wireless communication system arranged to have at least one transmit mode and at least one receive mode, the arrangement comprising at least three directional antennas in an antenna configuration, each directional antenna being arranged to have an azimuthal radiation pattern shaped as a beam, each beam covering an angular sector, such that a combined radiation pattern of all beams in a first transmit mode or in a first transmit and a first receive mode is arranged to provide a full 360° omnidirectional coverage. Said directional antennas are spatially arranged such that the beams covering neighbouring angular sectors partially overlap and such that the radiation patterns of all beams are arranged to be combined by connecting the directional antennas to the same transmitting line or the same transmitting and receiving line wherein:

- directional antennas placed within the λ-circle shall use substantially the same polarization as illustrated in FIGS. 4 and 8 and explained in association with these figures. This means that at least two directional antennas covering neighbouring angular sectors and with their phase centres within a circle with a radius below two λ are arranged in a first cluster in which all directional antennas have substantially the same polarization, where λ is a mean wavelength in the receive/transmit frequency band.
- the antenna arrangement comprises at least one cluster
- neighbouring beams having substantially orthogonal polarization as illustrated in FIGS. 5 and 7 are combined without causing null-depths. This means that the polarization of the separate directional antenna or the antenna cluster is substantially orthogonal to the polarization of the separate directional antenna or antenna cluster covering a neighbouring angular sector.
- the sum of antenna clusters and, separate directional antennas not included in a cluster, is an even number.
- a directional antenna is part of one cluster only, in the same antenna configuration.

In this way an omnidirectional azimuthal radiation pattern substantially without null-depths is created.

A separate directional antenna is a directional antenna not included in a cluster.

Figure 12:
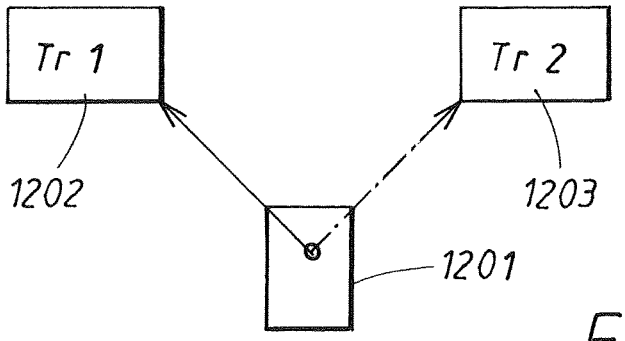
FIG. 12 schematically shows a switching arrangement.

Thus, this invention allows the same antenna configuration to be used both for sectorized and omnidirectional coverage, i.e., both site scenarios in FIG. 2 can be supported using a single antenna (and feeder, if desired) installation. However, in general, the invention can be used also for a combination of sectorized and omnidirectional coverage. The number of effective angular sectors, after combination of one or several neighbouring beams, can be any number between one and the number of sectors (or the number of beams as there is one beam per angular sector) in the site configuration. One sector corresponds to having a pattern that is the combination of the radiation patterns of all beams, i.e. one effective pattern. The solution for the switching arrangements between sectorized and omnidirectional coverage, which is a resource allocation operation involving signal routing and power-up/power-down of base station equipment, is known and is not part of the present invention. The switching arrangement is schematically illustrated in FIG. 12 with switching means 1201 switching between the first transmit mode, 1202, and the second transmit mode, 1203. A corresponding switching arrangement is used for switching between the first and the second receive mode.

An advantage of the invention is that it provides a low-cost, low complexity solution to the problem of generating a combined effective radiation pattern substantially without null-depths producing omnidirectional coverage using multiple directional antennas such as sector antennas or an array antenna connected to a common transmitting/receiving line. Each directional antenna produces one beam for a certain angular sector. The array antenna also produces one beam for each angular sector.

Figure 9:
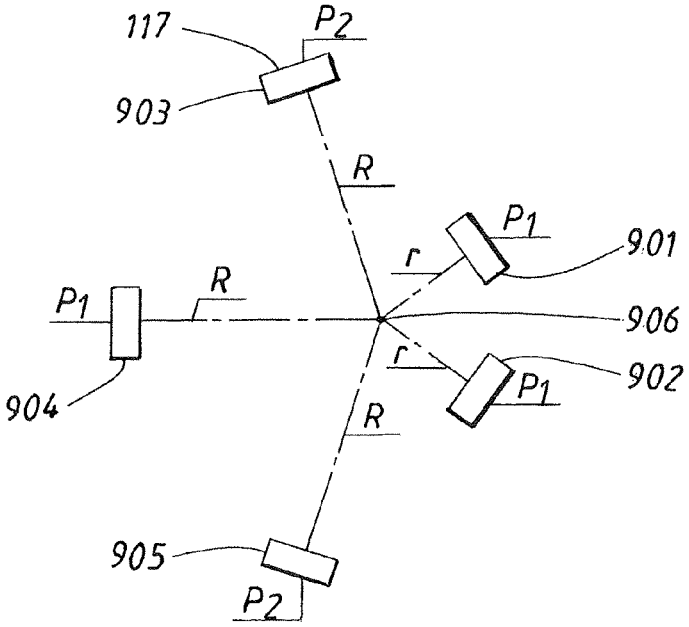
FIG. 9 schematically shows a configuration of five directional antennas according to the invention.

The invention is described for a three sector application using three directional antennas. The directional antennas used can be three-sector antennas, as they are optimized to cover a certain angular sector typically around 120°. Such an antenna produces one beam for this certain angular sector. The directional antenna can also e.g. be an array antenna producing one beam per angular sector. However the invention can also be implemented in configurations with any other number of sectors, odd or even, as long as the number of sectors is above or equal to three. An example of an embodiment with five directional antennas 901-905 is shown in FIG. 9. All directional antennas, in this example comprising sector antennas, have a directional radiation pattern, or a beam, in the azimuthal plane, normally being the horizontal plane. The first sector antenna 901 and the second sector antenna 902 have a radius r from the phase centers of the antennas to a common origin 906. The third sector antenna 903, the fourth sector antenna 904 and the fifth sector antenna 905 have a radius R from the phase centers of the sector antennas to the common origin 906. The first and the second sector antenna have the same polarization p1 and have a distance between phase centers being less than 4 wavelengths. The phase centers of the first and second sector antenna can therefore be inscribed within the λ-circle and they belong to the same cluster. The third, fourth and fifth sector antennas are all placed far, i.e. more than 4λ, from the first and second sector antenna. The third sector antenna 903 has a polarization p2 being substantially orthogonal to p1, the fourth sector antenna 904 has the polarization p1 and the fifth sector antenna 905 the polarization p2. This means that neighbouring sector antennas to the cluster antennas having the same polarization p1, have a substantially orthogonal polarization p2. When all five sector antennas are connected to the same transmitting/receiving line and the antenna patterns from the five sector antennas are combined there will be no interferometer patterns in the sector borders between the first and third sector antennas and between the second and fifth sector antenna as the neighbouring third and fifth sector antennas have a substantially orthogonal polarization to the cluster antennas. The forth sector antenna 904 has substantially the same polarization p1 as the cluster antennas. There will be no interferometer patterns in the sector borders between the fourth and third and the fourth and fifth sector antenna as the third and fifth sector antennas have a polarization p2 being substantially orthogonal to the polarization p1 of the fourth sector antenna. As the fourth sector antenna does not have a sector border with the first and second sector antenna there will also not be an overlapping radiation pattern between the fourth and the first or the fourth and the second sector antenna as the antenna patterns for all sector antennas are directional and thus there will be no interferometer pattern when the radiation patterns from the fourth, first and second sector antenna are combined although they have the same polarization p1. The only possible overlapping of radiation patterns from the fourth and the first and the fourth and the second sector antenna is the backlobe pattern of the fourth sector antenna which could overlap with the radiation patterns of the first and second sector antennas. The backlobe is however typically 25-40 dB below the level of the main lobe for typical sector antennas and thus has a negligible influence when the radiation patterns are combined. When there are more than three sector antennas in the antenna arrangement, and an omnidirectional pattern shall be produced through feeding the directional antenna/s with the same signal, the cluster antennas covering neighboring sectors shall have substantially the same polarization, and the cluster shall have neighbouring antennas or antenna clusters with a substantially orthogonal polarization. The cluster can comprise more than two directional antennas as long as their phase centers can be inscribed within the λ-circle. The antenna configuration can comprise one or several clusters. An antenna can only be part of one cluster in the same antenna configuration.

Figure 10:
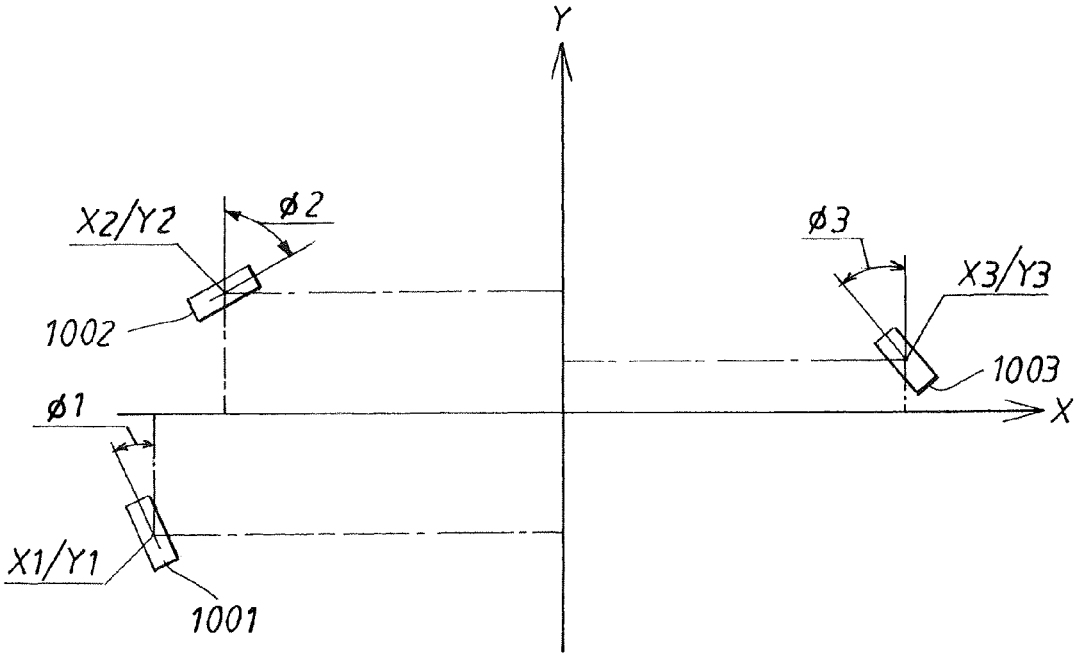
FIG. 10 schematically shows a general antenna configuration according to the invention.

The antennas do not have to be displaced along their respective main beam pointing direction, as represented by radial displacement from a common origin in the direction of vectors normal to the apertures of the antennas, as shown in FIGS. 1, 2, 6 and 9. FIG. 10 shows the directional antennas displaced in an X/Y-plane in a more general configuration. The first directional antenna 1001 and the second directional antenna 1002 belong to a cluster and have substantially the same polarization. The third directional antenna 1003 is placed far from the other two directional antennas and has a different polarization which is substantially orthogonal to the polarization of the first and the second directional antenna. As shown in FIG. 7 the distance to the third directional antenna having a different polarization than the first and the second directional antenna is not critical and the third directional antenna can actually be placed at any distance from the other two directional antennas. The first directional antenna can be placed at point X1/Y1 with an angle ϕ1 to the Y-axis, the second directional antenna at point X2/Y2 with an angle ϕ2 to the Y-axis and the third directional antenna at a point X3/Y3 with an angle ϕ3 to the Y-axis. The directional co-polarized antennas shall be placed in substantially the same X/Y-plane which e.g. can be the horizontal plane. As mentioned earlier the characteristics of each directional antenna can differ. The directional antennas can differ in characteristics such as e.g. antenna gain, azimuth and elevation beam width, and elevation pointing direction.

Figure 11:
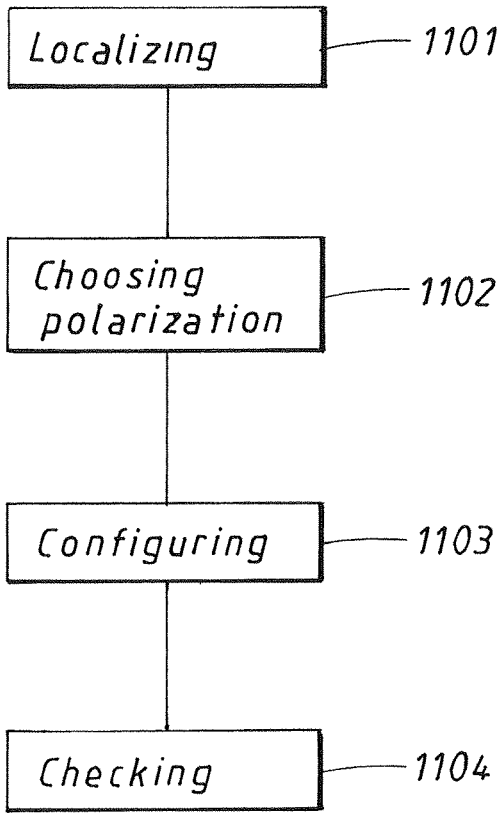
FIG. 11 shows a block diagram of the inventive method.

The invention also includes a method for an antenna arrangement comprising the following steps as illustrated in FIG. 11:

localizing, 1101, directional antennas in a first cluster. At least two directional antennas covering neighbouring angular sectors and with their phase centres within a circle with a radius below two λ are arranged in a first cluster in which all directional antennas have the same polarization, where λ is a mean wavelength in the receive/transmit frequency band. The antenna arrangement comprises at least one cluster.

choosing substantially orthogonal polarization, 1102, for overlapping beams of neighbouring angular sectors. The polarization of the separate directional antenna or the antenna cluster is substantially orthogonal to the polarization of the separate directional antenna or antenna cluster covering a neighbouring angular sector.

configuring, 1103, the antenna arrangement such that the sum of antenna clusters and, separate directional antennas not included in a cluster, is an even number.

checking, 1104, that one directional antenna is part of one cluster only, in the same antenna configuration.

The invention also provides a base station for communication with mobile terminals in a telecommunications network equipped with an antenna arrangement according to any one of the claims 1-11.

The embodiments used to illustrate the invention correspond, on downlink, to each antenna radiating the same amount of power, thus the antenna patterns can be combined taking into account only the gain of the antennas. In general, the invention allows the combination of the radiation patterns from antennas radiating different amounts of power, with the antennas having identical or different radiation patterns corresponding to controlled variations of the azimuthal angular sector coverage.

The radiation patterns used to illustrate the effects of combining multiple radiation patterns to combined effective patterns are to be interpreted as free space radiation patterns, i.e., radiation patterns that are only obtainable in an ideal radio wave propagation environment such as free space or in high-quality antenna measurement ranges. In general, the invention is applicable to arbitrary radio wave propagation environment, which exhibit varying degrees of angular spread.

The invention is not limited to the embodiments above, but may vary freely within the scope of the appended claims.

The invention claimed is:

1. An antenna arrangement for a wireless communication system arranged to have at least one transmit mode and at least one receive mode, the arrangement comprising at least three directional antennas in an antenna configuration, each directional antenna being arranged to have an azimuthal radiation pattern shaped as a beam, each beam covering an angular sector, such that a combined radiation pattern of all beams in a first transmit mode is arranged to provide a full 360° omnidirectional coverage, said directional antennas being spatially arranged such that the beams covering neighbouring angular sectors partially overlap and such that the radiation patterns of all beams are arranged to be combined by connecting the directional antennas to the same transmitting line characterized in that:

at least two directional antennas covering neighbouring angular sectors and with their phase centres within a circle with a radius below two λ are arranged in a first cluster in which all directional antennas have substantially the same polarization, where λ is a mean wavelength in the receive/transmit frequency band, the antenna arrangement comprises at least one cluster, the polarization of the separate directional antenna or the antenna cluster is substantially orthogonal to the polarization of the separate directional antenna or antenna cluster covering a neighbouring angular sector, the sum of antenna clusters and, separate directional antennas not included in a cluster, is an even number, a directional antenna is part of one cluster only, in the same antenna configuration thus creating an omnidirectional azimuthal radiation pattern substantially without null-depths.

2. An antenna arrangement according to claim 1, characterized in that the radiation patterns of all beams in a first receive mode are arranged to be combined by connecting the directional antennas to the same receiving line.

3. An antenna arrangement according to claim 1, characterized in that the directional antennas in a cluster are located in a substantially horizontal plane.

4. An antenna arrangement according to claim 1, characterized in that the beams of further separate directional antennas or antenna clusters in the antenna configuration shall have a substantially orthogonal polarization to beams covering neighbouring angular sectors.

5. An antenna arrangement according to claim 1, characterized in that the directional antennas are mounted on a common mast, tower, roof or roof-top or mounted on walls or similar structures.

6. An antenna arrangement according to claim 1, characterized in that the antenna configuration comprises three directional antennas, each directional antenna covering one angular sector, with a first and second directional antenna both having substantially the same polarization and belonging to the first cluster and a third separate directional antenna having a polarization being substantially orthogonal to the polarization of the first cluster.

7. An antenna arrangement according to claim 6, characterized in that the separation angle between the pointing directions of the directional antennas is substantially 120°.

8. An antenna arrangement according to claim 1, characterized in that phase adjusters are arranged to be implemented in one or more of the transmission lines, for fine tuning of the radiation pattern combined from the patterns of the individual directional antennas.

9. An antenna arrangement according to claim 1, characterized in that split signals in transmission lines emanating from one transmitting line are arranged to be amplified to compensate for the loss due to the splitting of the transmitting line signal and/or in that signals in the transmitting line are arranged to be amplified to compensate for the loss due to the splitting of the transmitting line signal.

10. An antenna arrangement according to claim 1, characterized in that in a second receive mode, a separate receiving line is arranged to be connected to each of the directional antennas, thus creating a sectorized coverage for uplink.

11. An antenna arrangement according to claim 1, characterized in that in a second transmit mode, a separate transmitting line is arranged to be connected to each of the directional antennas, thus creating a sectorized coverage for downlink, a switching means being arranged to switch between the first and the second transmit mode.

12. A base station for communication with mobile terminals in a telecommunications network equipped with an antenna arrangement according to claim 1.

13. A method for an antenna arrangement in a wireless communication system having at least one transmit mode and at least one receive mode, the arrangement comprising at least three directional antennas in an antenna configuration, each directional antenna having an azimuthal radiation pattern shaped as a beam, each beam covering an angular sector, such that a combined radiation pattern of all beams in a first transmit mode provides a full 360° omnidirectional coverage, said directional antennas being spatially arranged such that the beams covering neighbouring angular sectors partially overlap and such that the radiation patterns of all beams are combined by connecting the directional antennas to the same transmitting line characterized in that:

at least two directional antennas covering neighbouring angular sectors and with their phase centres within a circle with a radius below two $\lambda$ are localized in a first cluster in which all directional antennas have substantially the same polarization, where $\lambda$ is a mean wavelength in the receive/transmit frequency band, the antenna arrangement comprises at least one cluster, the polarization of the separate directional antenna or the antenna cluster is chosen to be substantially orthogonal to the polarization of the separate directional antenna or antenna cluster covering a neighbouring angular sector, the sum of antenna clusters and, separate directional antennas not included in a cluster, is configured to be an even number, a directional antenna is checked to be part of one cluster only, in the same antenna configuration thus creating an omnidirectional azimuthal radiation pattern substantially without null-depths.

14. A method for an antenna arrangement according to claim 13, characterized in that the radiation patterns of all beams in a first receive mode are combined by connecting the directional antennas to the same receiving line.

15. A method for an antenna arrangement according to claim 13, characterized in that the directional antennas in a cluster are located in a substantially horizontal plane.

16. A method for an antenna arrangement according to claim 13, characterized in that the beams of further separate directional antennas or antenna clusters in the antenna configuration shall have a substantially orthogonal polarization to beams covering neighbouring angular sectors.

17. A method for an antenna arrangement according to claim 13, characterized in that the directional antennas are mounted on a common mast, tower, roof or roof-top or mounted on walls or similar structures.

18. A method for an antenna arrangement according to claim 13, characterized in that the antenna configuration comprises three directional antennas, each directional antenna covering one angular sector, with a first and second directional antenna both having substantially the same polarization and belonging to the first cluster and a third separate directional antenna having a polarization being substantially orthogonal to the polarization of the first cluster.

19. A method for an antenna arrangement according to claim 18, characterized in that the separation angle between the pointing directions of the directional antennas is substantially 120°.

20. A method for an antenna arrangement according to claim 13, characterized in that phase adjusters are implemented in one or more of the transmission lines for fine tuning of the radiation pattern combined from the patterns of the individual directional antennas.

21. A method for an antenna arrangement according to claim 13, characterized in that split signals in transmission lines emanating from one transmitting line are amplified to compensate for the loss due to the splitting of the transmitting line signal and/or in that signals in the transmitting line are amplified to compensate for the loss due to the splitting of the transmitting line signal.

22. A method for an antenna arrangement according to claim 13, characterized by in a second receive mode, a separate receiving line being connected to each of the directional antennas, thus creating a sectorized coverage for uplink.

23. A method for an antenna arrangement according to claim 13, characterized in that in a second transmit mode, a separate transmitting line being connected to each of the directional antennas, thus creating a sectorized coverage for downlink, a switching means switching between the first and the second transmit mode.

* * * * *